US005187826A

United States Patent [19]

Mariol

[11] Patent Number: 5,187,826

[45] Date of Patent: Feb. 23, 1993

[54] CONVERTIBLE CRADLE

[75] Inventor: John V. Mariol, Cincinnati, Ohio

[73] Assignee: James F. Mariol, Cincinnati, Ohio

[21] Appl. No.: 840,407

[22] Filed: Feb. 24, 1992

[51] Int. Cl.[5] ..... A47D 1/00; A47D 9/00

[52] U.S. Cl. ..... 5/655; 5/657; 5/414; 5/101; 297/295

[58] Field of Search ..... 297/274, 295, 296, 297, 297/457; 5/655, 657, 658, 634, 101, 102, 104, 105, 414, 416

[56] References Cited

U.S. PATENT DOCUMENTS

| | | | |
|---|---|---|---|
| 2,735,716 | 2/1956 | Shimabukuro | 5/416 X |
| 2,988,136 | 6/1961 | Kowalczyk | 155/49 |
| 3,004,793 | 10/1961 | Loomis | 5/176.1 X |
| 3,069,202 | 12/1962 | Gottfried et al. | 297/355 |
| 3,110,519 | 11/1963 | Charnivsky | 297/457 X |
| 3,890,660 | 6/1975 | Pedler | 5/101 |
| 4,188,678 | 2/1980 | Rawolle | 297/274 X |
| 4,200,331 | 4/1980 | Uchida | 297/45 |
| 4,295,683 | 10/1981 | Dubbink et al. | 297/397 |
| 4,553,786 | 11/1985 | Lockett, III et al. | 297/250 |
| 4,602,395 | 7/1986 | Kassai | 5/102 X |
| 4,723,815 | 2/1988 | Kassai | 297/355 |
| 4,836,573 | 6/1989 | Gebhard | 280/644 |

FOREIGN PATENT DOCUMENTS 0028992 10/1980 European Pat. Off. .

*Primary Examiner*—Michael F. Trettel

*Attorney, Agent, or Firm*—Dressler, Goldsmith, Shore, Sutker & Milnamow, Ltd.

[57] ABSTRACT

A cradle for an infant is convertible between a seat and a bed. The cradle has a stationary structure and a pivotable structure mounted to the stationary structure for pivotal movement about a transverse axis between a seat position and a bed position. A cover attached to a back portion of an upper section of the stationary structure and to a back portion of the pivotable structure and collapsible when the pivotable structure is pivoted to the seat position provides a barrier against drafts in the bed position of the pivotable structure. A pair of foldable braces and a pair of hooks are provided for securing the pivotable structure releasably in the bed and seat positions respectively. The hooks coact with pins used to mount the braces.

16 Claims, 5 Drawing Sheets

CONVERTIBLE CRADLE

TECHNICAL FIELD OF THE INVENTION

This invention pertains to an improved cradle for an infant. The improved cradle can be easily converted between a seat and a bed. When converted to a bed, the improved cradle has a barrier against drafts.

BACKGROUND OF THE INVENTION

Lightweight cradles of a type that can be readily disassembled for storage or travel have become very popular. Some of these cradles are convertible between seats and beds.

Typically, such a cradle employs interfittable wire and tubular frames and a fabric cover, which has straps to restrain an infant sitting in the cradle from falling. Often, the wire frames have some resiliency so that an infant sitting in the cradle can cause the cradle to bounce gently This invention has resulted from efforts to develop an improved cradle that can be easily converted between a seat and a bed.

SUMMARY OF THE INVENTION

This invention provides an improved cradle that can be easily converted between a seat and a bed. When it is converted to a bed, a barrier against drafts is provided.

The improved cradle comprises a stationary structure and a pivotable structure. The stationary structure has a lower section adapted to stand on a floor and also may have an upper section. The pivotable structure is mounted to the stationary structure so as to permit pivotal movement of the pivotable structure about a transverse axis between a seat position wherein a back portion of the pivotable structure is raised and a bed position wherein the same portion is lowered. The pivotable structure provides a seat for an infant in the seat position and a bed for an infant in the bed position.

A cover is attached to a back portion of the pivotable structure and may be also attached to a back portion of the upper section of the stationary structure. The cover provides a barrier against drafts at least in the seat position of the pivotable structure. If attached to the back portions of the pivotable structure and of the upper section of the stationary structure, the cover is collapsible when the pivotable structure is pivoted from the bed position into the seat position.

Preferably, at least one brace is mounted between the stationary structure and the pivotable structure. The brace is adapted to position and brace the pivotable structure in the bed position and is foldable to permit pivotal movement of the pivotable structure to the seat position. Desirably, a pair of such braces are provided, respectively on opposite sides of the cradle.

Preferably, the cradle comprises a pin mounted to one of the stationary and pivotable structures, preferably to the pivotable structure, and a hook mounted to the other structure. The hook is manipulatable so as to coact with the pin to secure the pivotable structure releasably in the seat position. Desirably, a pair of such hooks are provided, respectively on opposite sides of the cradle.

In a preferred construction, in which each brace comprises upper and lower links mounted via upper and lower pins, the hook is movable so as to coact with one of the same pins. It is advantageous for the hook to be mounted pivotally to the stationary frame via one of the same pins, preferably the upper pin, and to be manipulatable so as to coact with the other pin. Also, the hook may be weighted so as to tend to coact automatically with the lower pin upon pivotal movement of the pivotable structure to the seat position.

These and other objects, features, and advantages of this invention are evident from the following description of a preferred embodiment of this invention with reference to the accompanying drawings.

DETAILED DESCRIPTION OF PREFERRED EMBODIMENT

Figure 1:
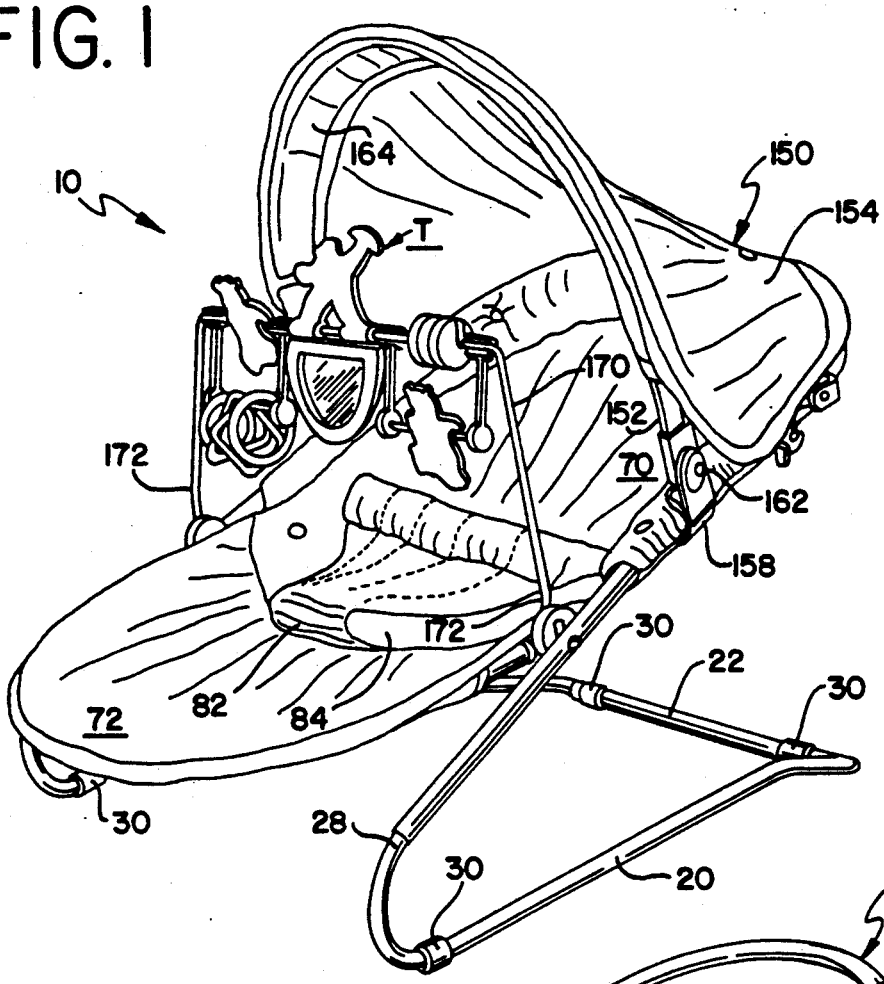
FIG. 1 is a front, perspective view of a cradle according to this invention, equipped with a canopy and with a toy bar, both being removable, convertible between a seat and a bed, and shown as converted to a seat.

As shown in the drawings, an improved cradle 10 for an infant constitutes a preferred embodiment of this invention. The cradle 10 can be conveniently converted between a more upright position (see, e.g., FIGS. 1 and 4) wherein it serves as a seat and a more inclined position (see, e.g., FIG. 3) wherein it serves as a bed. The cradle 10 can be alternatively secured in either position.

Figure 2:
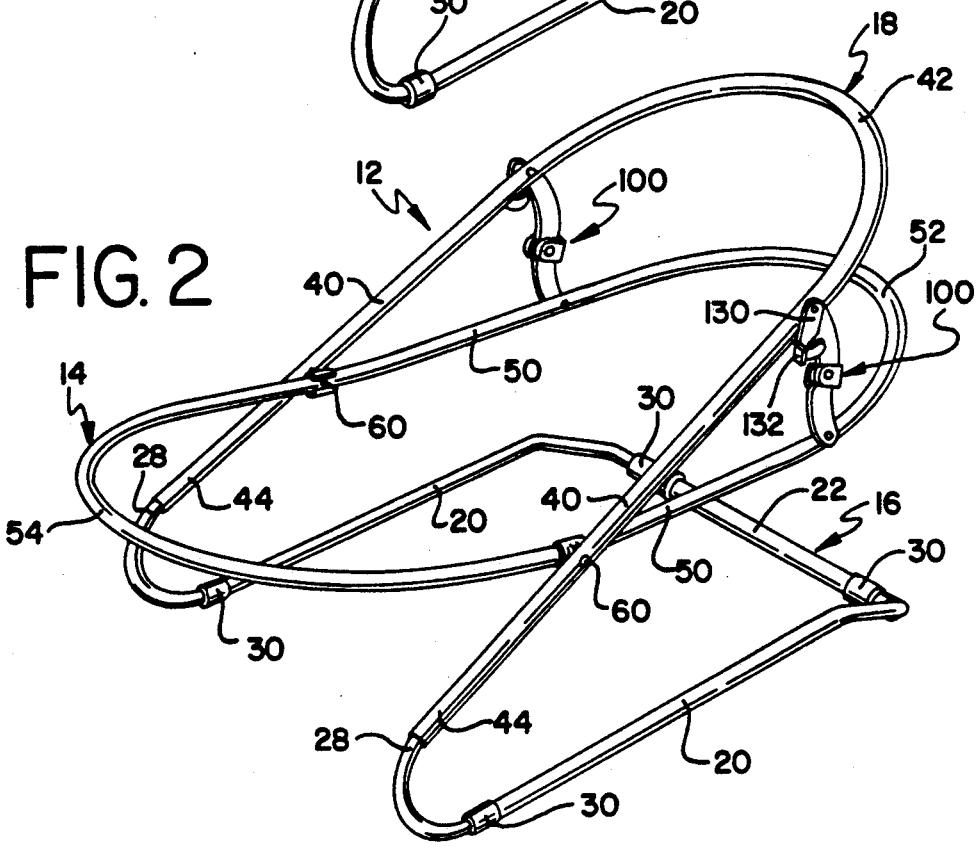
FIG. 2 is a front, perspective view of pivotally connected frames of the cradle, as converted to a bed.
Figure 3:
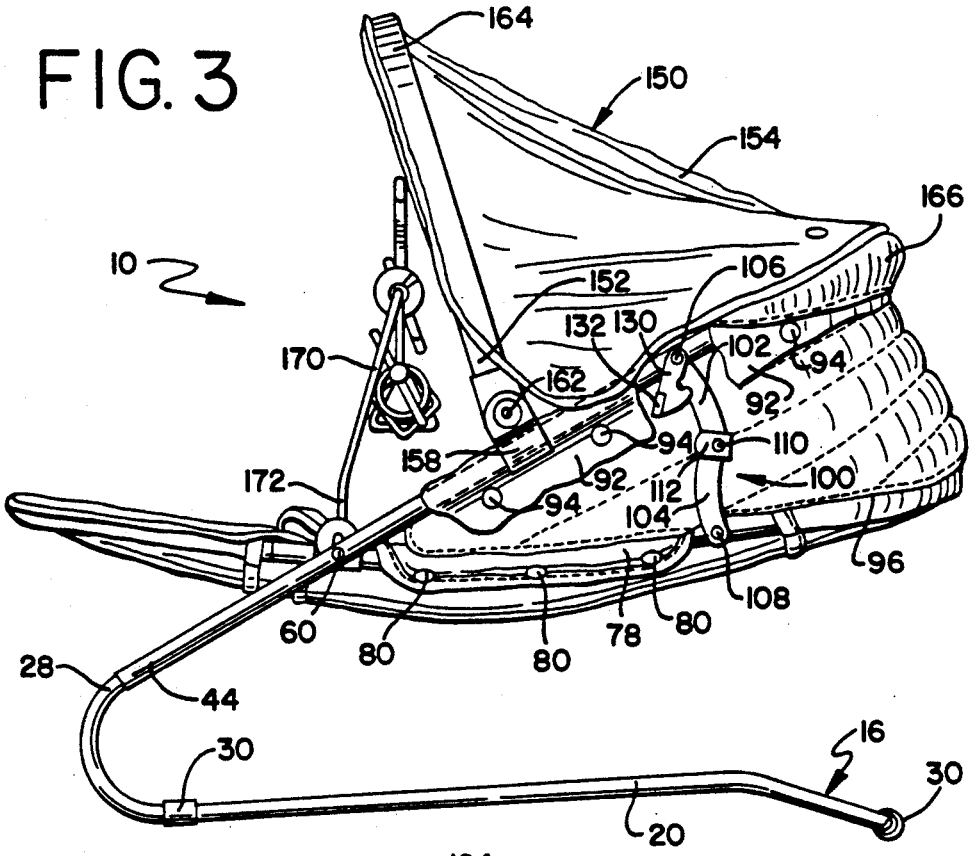
FIG. 3 is a side, elevational view of the cradle with the canopy and toy bar, as converted to a bed.
Figure 4:
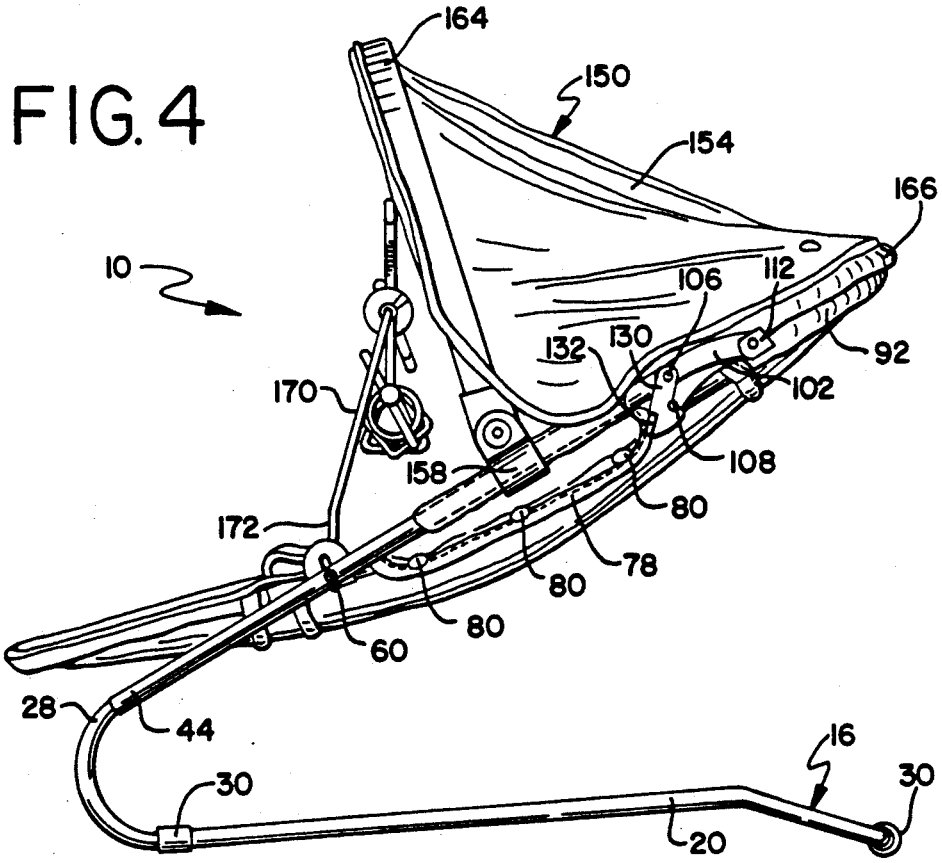
FIG. 4 is a side, elevational view of the cradle with the canopy and toy bar, as converted to a seat.
Figure 5:
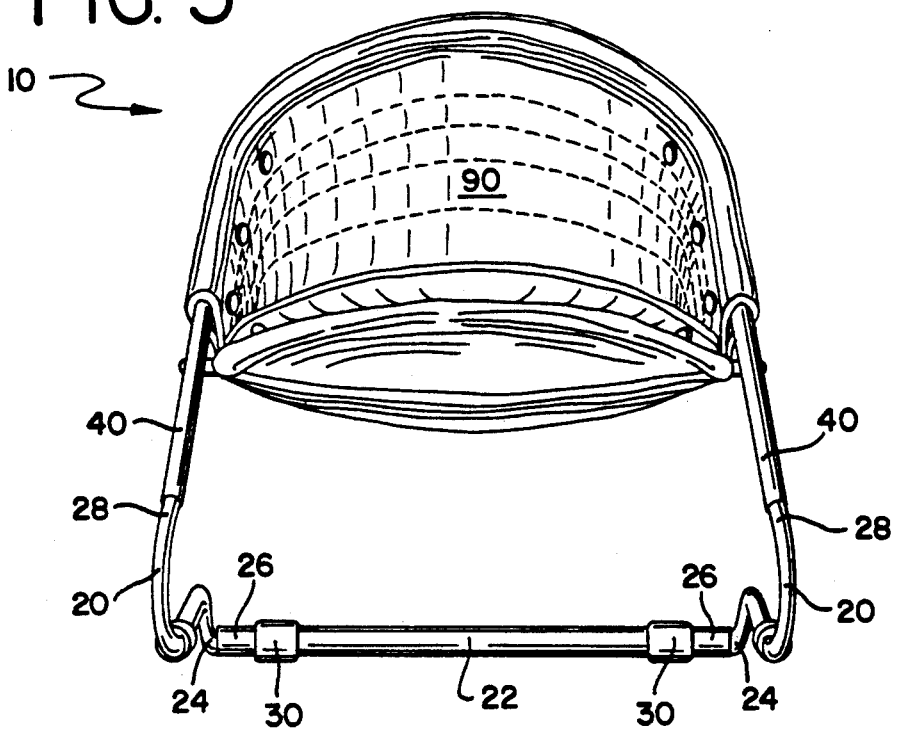
FIG. 5 is a front, elevational view of the cradle without the canopy and toy bar, as converted to a bed.
Figure 6:
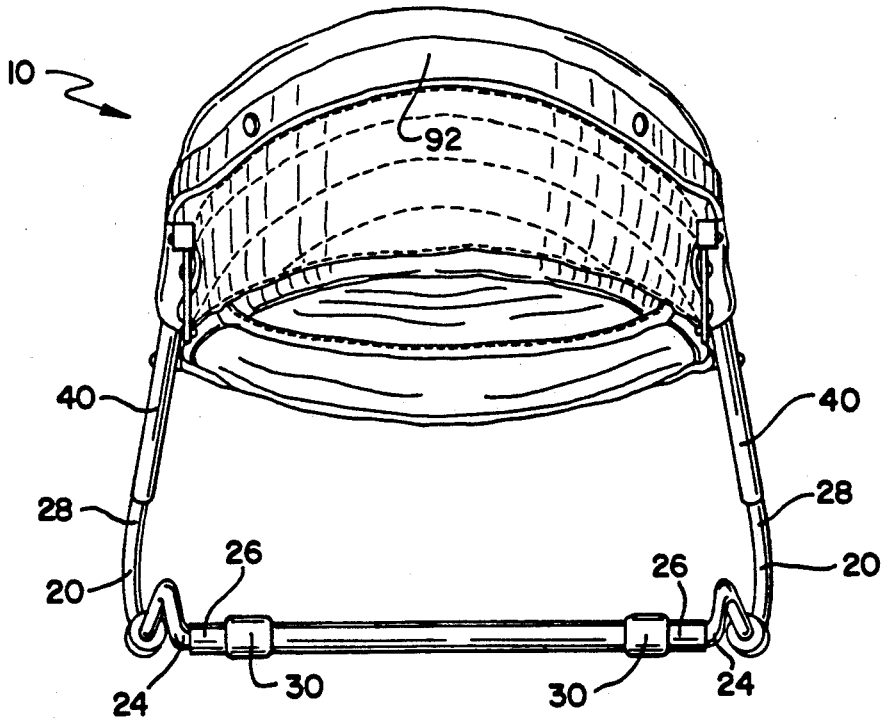
FIG. 6 is a back, elevational view of the cradle without the canopy and toy bar, as converted to a seat.
Figure 7:
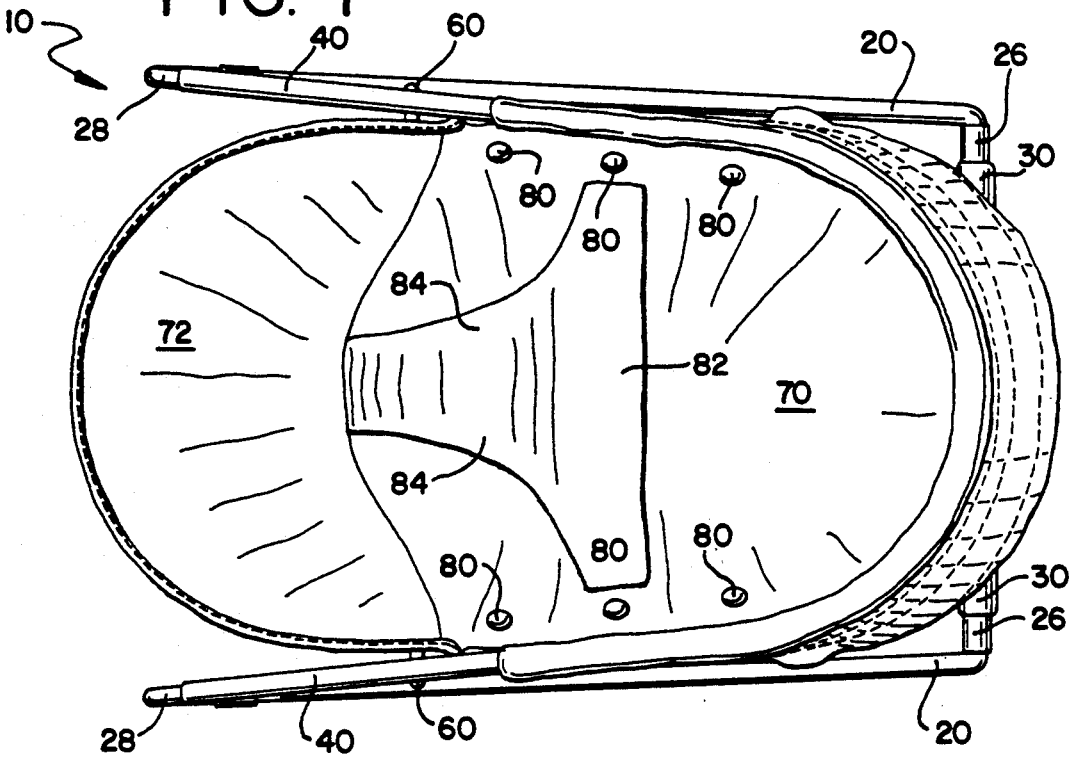
FIG. 7 is a top, plan view of the cradle without the canopy and toy bar, as converted to a bed.

As shown in FIG. 2 and other views, the cradle 10 comprises a stationary structure or frame 12 and a pivotable structure or frame 14, which are connected pivotally to each other in a manner to be later described. The stationary frame 12 has a lower section 16, which is adapted to stand on a floor, and an upper section 18. The lower section 16 of the stationary frame 12 has two lateral members 20, each being formed from metal wire having some springiness, and a back member 22 formed from a metal tube. Near the back of the cradle 10, back end portions 24 of the lateral members 20 are bent so as to extend inwardly, as shown in FIGS. 5 and 6 and other views. The back end portions 24 are inserted snugly into the opposite ends 26 of the back member 22. Near the front of the cradle 10, front end portions 28 of the lateral members 20 are bent upwardly and backwardly, as shown in FIGS. 3 and 4 and other views. Anti-skid sleeves 30 of elastomeric material are mounted on the lower section 16, at the opposite ends of the back member 22 and near the front end portions 28 of the lateral members 20.

As shown in FIG. 2, the upper section 18 of the stationary frame 12 is formed from a metal tube bent so as to have two lateral portions 40 and a curved, transverse or back portion 42 connecting the lateral portions 40 near the back of the cradle 10. The front end portions 28 of the lateral members 20 are inserted snugly into the opposite ends 44 of the lateral portions 40.

As shown in FIG. 2, the pivotable frame 14 is formed from a metal tube welded into a continuous oval and bent so as to have two lateral portions 50, a curved, transverse or back portion 52 connecting the lateral portions 50 near the back of the cradle 10, and a curved, transverse or front portion 54 connecting the lateral portions near the front of the cradle 1. The pivotable frame 14 is connected to the stationary frame 12, via a pivot pin 60 at each side of the cradle 10, so as to be pivotable between the more upright or seat position wherein the transverse portion 52 is raised and the less upright or bed position wherein the transverse portion 52 is lowered. The pivot pins 60 extend transversely through suitable apertures in the lateral members 20 of the stationary frame 12 and in the lateral portions 50 of the pivotable frame 14. The pivot pins 60 define a common, transverse axis, about which the pivotable frame 14 is pivotable.

Figure 8:
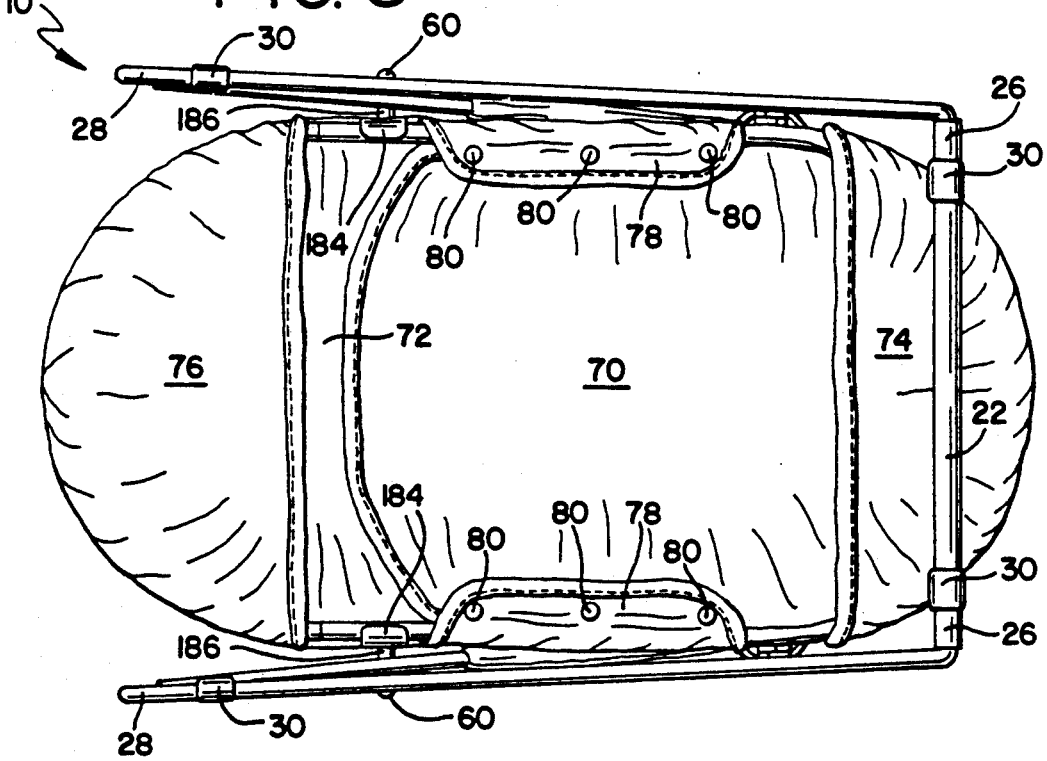
FIG. 8 is a bottom, plan view of the cradle without the canopy and toy bar, as converted to a bed.

A back cover 70 and a front cover 72 are attached removably to the pivotable frame 14 so as to form a pivotable structure providing a seat for an infant in the seat position of the pivotable frame 14 and providing a bed for an infant in the bed position of the pivotable frame 14. The covers 70, 72, are made from a suitable fabric. As best seen in FIG. 8, the back cover 70 has a sewn pocket 74 covering the transverse portion 52 of the pivotable frame 14. The front cover 72 has a sewn pocket 76 covering and receiving the transverse portion 54 of the pivotable frame 14. A front portion of the back cover 70 overlies a back portion of the front cover 72. The front cover 72 has two lateral tabs 78 drawn around the lateral portions 50 of the pivotable frame 14. Snap fasteners 80 are used to fasten the lateral tabs 78 removably to lateral portions of the back cover 70 and to lateral portions of the front cover 72.

As another component of the pivotable structure comprising the pivotable frame 14 and the covers 70, 72, a fabric restraint 82 defining two leg openings 84 is sewn to the front portion of the back cover 72 to restrain an infant occupying the cradle 10 from falling frontwardly in the seat position of the pivotable structure.

A cover 90 made from a suitable fabric provides a barrier against drafts in the bed position of the pivotable structure comprising the pivotable frame 14. The cover 90 is formed into a cuff 92 drawn around the transverse portion 42, and around adjacent ends of the lateral portions 40, and is fastened therearound via snap fasteners 94, so as to attach the cover to the transverse portion 42 of the upper section 18 of the stationary frame 12. A lower edge 96 of the cover 90 is sewn to the back cover 70 so as to attach the cover 90 to the transverse portion 52 of the pivotable frame 14. The cover 90 is stitched along lateral lines, as shown, so as to be collapsible into a compact bundle when the pivotable structure is pivoted from the bed position into the seat position.

Figure 9:
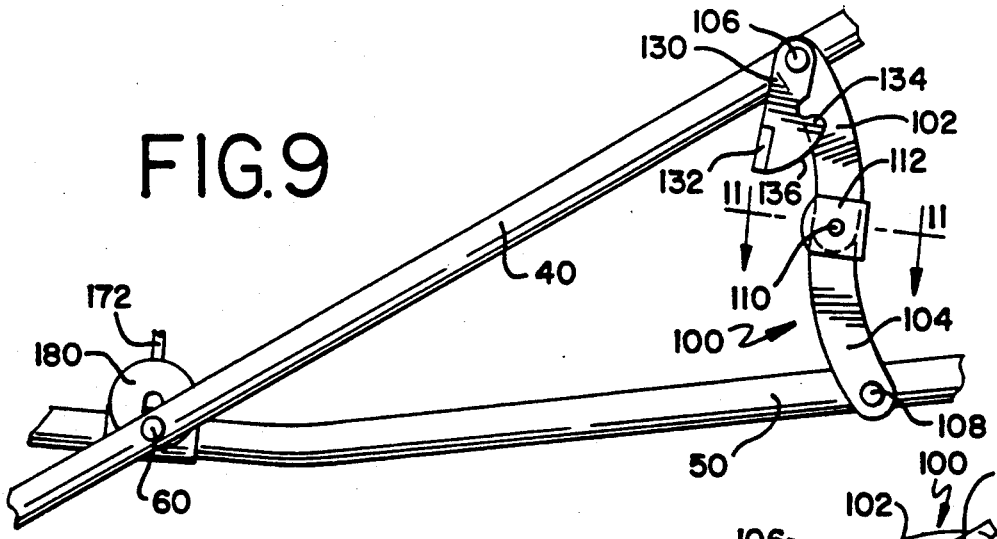
FIG. 9 is a fragmentary, side, elevational view of the frames, one of a pair of associated connectors, one of a pair of associated braces, and one of a pair of associated hooks, as shown in their respective positions when the cradle is converted to a bed. The hook is shown in an alternative arrangement in dashed lines.
Figure 10:
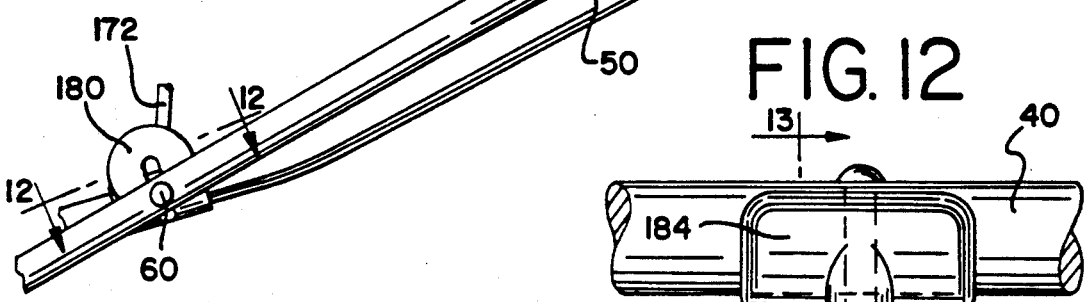
FIG. 10 is a similar view thereof, as shown in their respective positions when the cradle is converted to a seat.

As shown in FIG. 2, FIG. 9, and other views, a pair of similar braces 100 are used to brace the pivotable structure comprising the pivotable frame 14 releasably in the bed position. The braces 100 are foldable, as shown by a comparison of FIGS. 9 and 10, so as to permit pivotal movement of the pivotable structure between the seat and bed positions.

Figure 11:
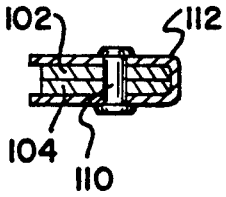
FIG. 11 is an enlarged, sectional detail taken along line 11—11 of FIG. 9, in a direction indicated by arrows.

Each brace 100 comprises an upper link 102 and a lower link 104, an upper pin 106, a lower pin 108, and a middle pin 110, and a U-shaped member 112. The upper pin 106 mounts the upper link 102, near its upper end, pivotally to the stationary frame 12 approximately where the transverse portion 42 adjoins one of the lateral portions 40. The lower pin 108 mounts the lower link 104, near its lower end, pivotally to the pivotable frame 14 approximately where the transverse portion 52 adjoins one of the lateral portions 50. The middle pin 110 mounts the links 102, 104, pivotally to each other, near the lower end of the upper link 102 and near the upper end of the lower link 104. As shown in FIG. 11 and other views, the middle pin 110 mounts the U-shaped member 112, which embraces the lower end of the upper link 102 and the upper end of the lower link 104 so as to limit pivotal movement of the links 102, 104, past an overcenter position of the links 102, 104. Thus, as described so far, each brace 100 is similar to folding braces of a well known type used heretofore in foldable furniture.

Each of the pins 106, 108, 110 of each brace 100 has an enlarged head on each end. Thus, the upper pin 106 has an enlarged, outer head, which is spaced outwardly from the upper link 102. Also, the lower pin 108 has an enlarged, outer head, which is spaced outwardly from the lower link 104. Moreover, on each brace 100, a hook 130 is mounted pivotally between the outer head of the upper pin 106 and the upper link 102. The hook 130 is formed from sheet metal so as to have a tab 132 extending outwardly and a recessed portion 134 fittable between the outer head of the lower pin 108 and the lower end of the lower link 104. The hook 130 is movable so as to coact with the lower pin 108 by hooking onto the lower pin 108, between the outer head of the lower pin 108 and the lower end of the lower link 104, thereby to secure the pivotable frame 14 releasably in the seat position. A lower edge 136 of the hook 130 is curved as to cam the hook 130 pivotally in a rotational sense displacing the tab 143 frontwardly (i.e. in a clockwise sense in FIGS. 9 and 10) if the hook 130 engages the lower pin 108 upon pivotal movement of the pivotable structure comprising the frame 14 toward the seat position. The tab 132 weights the hook 130 in such manner that the hook 130 tends to pivot oppositely (i.e. in a counter-clockwise sense in FIGS. 9 and 10) so that the hook 130 tends to coact automatically with the lower pin 108 when the pivotable structure comprising the pivotable frame 14 reaches the seat position. Also, the tab 132 facilitates manipulation of the hook 130, as when it is desired to release the pivotable frame 14.

In an alternative arrangement shown in dashed lines in FIG. 9, the hook 130 could be pivotally mounted between the outer head of the lower pin 108 and the lower link 104. The hook 130 would be then movable so as to coact with the upper pin 106 by hooking onto the upper pin 106, between the outer head of the upper pin 106 and the upper end of the upper link 102.

The cradle 10 comprises a canopy 150, which includes a generally U-shaped frame 153 and a fabric cover 154. The canopy frame 150 is mounted removably to the stationary frame 12 via a pair of similar, generally C-shaped clamps 158. Each clamp 158 is connected pivotally to one of the opposite ends of the canopy frame 150, via a pivot pin 162, and is snapped over one of the lateral portions 40 of the upper section 18 of the stationary frame 12 with one of the cuffs 92 of the fabric cover 90 therebetween. The fabric cover 154 has a sewn hem 164, through which the canopy frame 152 extends, and a back pocket 166, which fits over the transverse portion 42 of the upper section 18 of the stationary frame 12 when the canopy 150 is installed.

Figure 12:
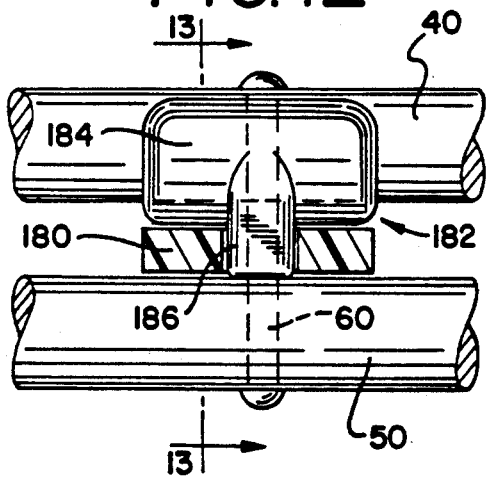
FIG. 12 is a similarly enlarged, fragmentary, sectional detail taken along line 12—12 of FIG. 10, in a direction indicated by arrows.
Figure 13:
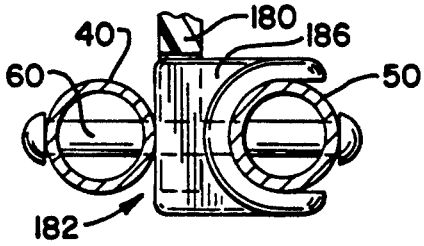
FIG. 13 is a similarly enlarged, fragmentary, sectional detail taken along line 13—13 of FIG. 12, in a direction indicated by arrows.

The cradle 10 comprises a toy bar 170, which is adapted to hold diverse toys T, as shown in FIGS. 1 and 3. The toy bar 170, which is generally U-shaped, is mounted removably to the cradle 10 at opposite ends 172 of the toy bar 170 via a pair of similar connectors 180 coacting with a pair of similar blocks 182. Each connector 180 is bifurcated, as shown in FIGS. 12 and 13, and has a socket receiving one of the bar ends 172. Each block 182 is mounted on one of the pivot pins 60, between the associated one of the lateral portions 40 of the upper section 18 of the stationary frame 12 and the associated one of the lateral portions 50 of the pivotable frame 14. Each block 182 has a C-shaped portion 184 embracing the associated lateral portion 40 so as to prevent pivotal motion of such block 182 relative to the stationary frame 12. Each connector 180 fits removably over a wall portion 186 of the associated block 182. Advantageously, the toy bar 170 tends to remain in a generally upright position whether the pivotable portion is in the seat or bed position, since pivotal movement of the connectors 180 relative to the stationary frame 12 is prevented.

Various modifications may be made in the preferred embodiment described above without departing from the scope and spirit of this invention.

I claim:

1. A cradle for an infant, the cradle comprising (a) a stationary structure having a lower section structured to resist movement on a floor and also having an upper section, (b) a pivotable structure having a back portion and a front portion, the pivotable structure being mounted to the stationary structure and extending forwardly and rearwardly about a transverse axis so as to permit pivotal movement of the pivotable structure about the transverse axis between a seat position wherein the rearwardly extending back portion of the pivotable structure is raised and the forwardly extending front portion of the pivotable structure is lowered and a bed position wherein the rearwardly extending back portion of the pivotable structure is lowered and the forwardly extending front portion of the pivotable structure is raised, the pivotable structure providing a seat for an infant in the seat position and providing a bed for an infant in the bed position, and (c) a cover attached to the upper section of the stationary structure and the rearwardly extending back portion of the pivotable structure only in back of the transverse axis, the cover being arranged to provide a barrier against drafts at least in the bed position of the pivotable structure.

2. The cradle of claim 1 with the cover being collapsible when the pivotable structure is pivoted from the bed position into the seat position.

3. The cradle of claim 1 comprising means for positioning the pivotable structure alternatively in the bed position and in the seat position.

4. The cradle of claim 3 wherein said positioning means comprises at least one brace mounted between the stationary structure and the pivotable structure, adapted to position and brace the pivotable structure in the bed position, and foldable to permit pivotal movement of the pivotable structure to the seat position.

5. A cradle for an infant, the cradle comprising (a) a stationary structure having a lower section adapted to stand on a floor, (b) a pivotable structure having a back portion and being mounted to the stationary structure so as to permit pivotal movement of the pivotable structure about a transverse axis between a seat position wherein the back portion of the pivotable structure is raised and a bed position wherein the back portion of the pivotable structure is lowered, the pivotable structure providing a seat for an infant in the seat position and providing a bed for an infant in the bed position, (c) a cover attached to the back portion of the pivotable structure and arranged to provide a barrier against drafts at least in the bed position of the pivotable structure, and (d) means for positioning the pivotable structure alternatively in the bed position and in the seat position, wherein said positioning means comprises at least one brace mounted between the stationary structure and the pivotable structure, adapted to position and brace the pivotable structure in the bed position, and foldable to permit pivotal movement of the pivotable structure to the seat position, and wherein the brace comprises an upper link and a lower link, means including an upper pin for mounting the upper link pivotally to the upper section of the stationary structure, means including a lower pin for mounting the lower link pivotally to the pivotable structure, means including a middle pin for mounting the upper and lower links pivotally to each other, and means for limiting pivotal movement of the upper and lower links past an overcenter position of the brace.

6. The cradle of claim 5 comprising a pair of said braces disposed respectively on opposite sides of the cradle.

7. The cradle of claim 6 comprising a pair of hooks, each hook being mounted to one of the stationary and pivotable structures, each hook being manipulatable so as to coact with one of the pins to secure the pivotable structure releasably in the seat position.

8. The cradle of claim 7 wherein each hook is mounted pivotally to the stationary frame via one of the upper pins of said braces and is movable so as to coact with one of the lower pins of said braces.

9. The cradle of claim 8 wherein each hook is weighted so as to tend to coact automatically with one of the lower pins upon pivotal movement of the pivotable structure to the seat position.

10. The cradle of claim 5 comprising a hook mounted to one of the stationary and pivotable structures and manipulatable so as to coact with one of the pins to secure the pivotable structure releasably in the seat position.

11. The cradle of claim 10 wherein the hook is mounted pivotally to the stationary structure via the upper pin and is manipulatable so as to coact with the lower pin.

12. The cradle of claim 11 wherein the hook is weighted so as to tend to coact automatically with the lower pin upon pivotal movement of the pivotable structure to the seat position.

13. A cradle for an infant, the cradle comprising (a) a stationary structure having a lower section adapted to stand on a floor, (b) a pivotable structure having a back portion and being mounted to the stationary structure so as to permit pivotal movement of the pivotable structure about a transverse axis between a seat position wherein the back portion of the pivotable structure is raised and a bed position wherein the back portion of the pivotable structure is lowered, the pivotable structure providing a seat for an infant in the seat position and providing a bed for an infant in the bed position, (c) a cover attached to the back portion of the pivotable structure and arranged to provide a barrier against drafts at least in the bed position of the pivotable structure, and (d) a pin mounted to one of the stationary and pivotable structures and a hook mounted to the other structure, the hook being movable so as to coact with the pin to secure the pivotable structure in the seat position.

14. The cradle of claim 13 wherein the pin is mounted to the pivotable structure and the hook is mounted to the stationary structure.

15. The cradle of claim 14 wherein a said pin and a said hook are disposed respectively on each side of the cradle.

16. The cradle of claim 15 wherein the pins are mounted to the pivotable structure and the hooks are mounted to the stationary structure.

* * * * *